United States Patent [19]

Child

[11] 4,399,314

[45] Aug. 16, 1983

[54] PROCESS FOR THE PRODUCTION OF FUELS FROM TAR SANDS

[75] Inventor: Edward T. Child, Tarrytown, N.Y.

[73] Assignee: Texaco Development Corporation, White Plains, N.Y.

[21] Appl. No.: 344,333

[22] Filed: Feb. 1, 1982

[51] Int. Cl.[3] ..... C10G 1/04

[52] U.S. Cl. ..... 208/11 LE; 208/8 LE; 208/8 R; 208/11 R

[58] Field of Search ..... 208/11 LE, 8 LE, 11 R, 208/8 R

[56] References Cited

U.S. PATENT DOCUMENTS 3,607,720 9/1971 Paulson ..... 208/11 LE 4,098,674 7/1978 Rammler et al. ..... 208/11 LE

*Primary Examiner*—Delbert E. Gantz

*Assistant Examiner*—A. Pal

*Attorney, Agent, or Firm*—Carl G. Ries; Robert A. Kulason; Robert Knox, Jr.

[57] ABSTRACT

An integrated process for the production of fuels from tar sands in which bitumen is recovered from the tar sand by a hot-water separation step, recovered bitumen is converted in a hydroconversion step to gaseous and liquid fuels, carbonaceous residue from the bitumen conversion step is gasified with oxygen to produce synthesis gas, hot synthesis gas from the gasification step is water washed, hot water from the water wash step provides hot water for the separation step, and synthesis gas from the gasification step provides hydrogen for the bitumen conversion step. Soot recovered from the synthesis gas in the water wash step is transferred to the bitumen in the separation step and ultimately consumed in the process. Water contaminants from the tar sand separation step are largely eliminated in the gasification step.

10 Claims, 1 Drawing Figure

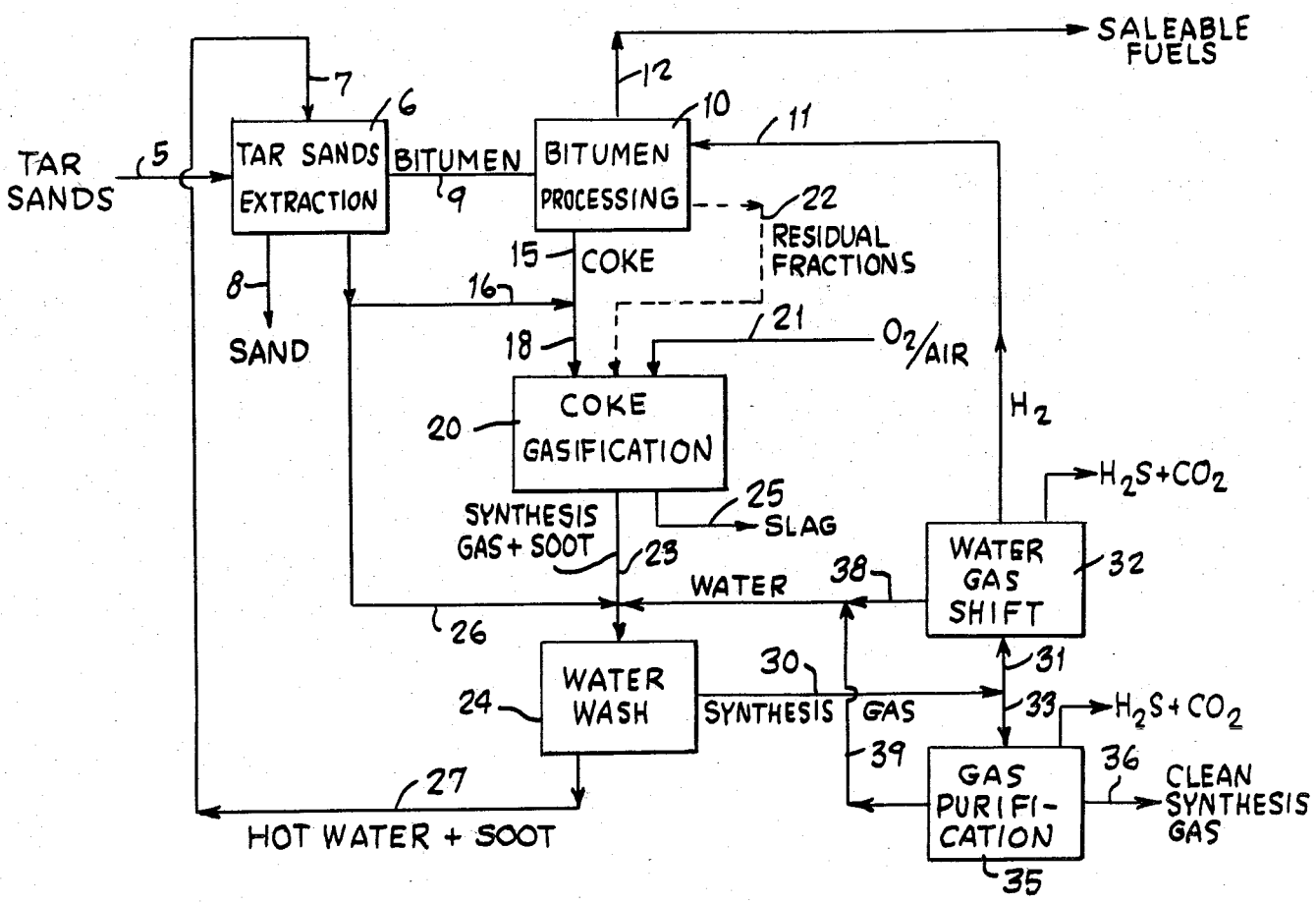
SALEABLE FUELS
12
10
11
BITUMEN PROCESSING
22
RESIDUAL FRACTIONS
21
$O_2$/AIR
COKE
15
16
18
COKE GASIFICATION
20
25
SLAG
23
SYNTHESIS GAS + SOOT
26
WATER
38
$H_2$
WATER GAS SHIFT
32
31
$H_2S+CO_2$
33
GAS PURIFI-CATION
35
36
$H_2S+CO_2$
CLEAN SYNTHESIS GAS
39
GAS
30
SYNTHESIS
WATER WASH
24
27
HOT WATER + SOOT
BITUMEN
9
6
TAR SANDS EXTRACTION
7
8
SAND
5
TAR SANDS

PROCESS FOR THE PRODUCTION OF FUELS FROM TAR SANDS

This invention relates to a process for the production of liquid and gaseous fuels from tar sands. In one of its more specific aspects, the invention relates to a combination of process steps involving extraction of bitumen from tar sand by a hot water extraction process, hydroconversion of recovered bitumens to gaseous and liquid fuels of lower molecular weight than the bitumens, and gasification of residual components of the bitumen by reaction with free oxygen to produce synthesis gas and heat for said tar sand extraction. This invention provides a combination of process steps wherein energy available from tar sand is utilized in a highly efficient manner.

Tar sand, as the term is used in the art, refers to a naturally occurring friable consolidated mixture of bitumen and sand. Typical tar sands useful in the process of this invention are those of the Athabasca Tar Sand deposit in the providence of Alberta, Canada. The Athabasca Tar Sand deposit is commercially mined and processed for the recovery of bitumen. Analysis of Athabasca Tar Sand yields an average bitumen content of approximately 12 to 13 percent by weight.

Athabasca Tar Sands, as mined, contain approximately 3 to 5 weight percent connate water. The equilibrium structure of Athabasca Tar Sands reportedly consists of sand particles mixed with but separated from the bitumen by a film of connate water, in which the connate water surrounds each grain of sand thereby separating the bitumen from the sand grains. Regardless of the exact nature of the physical composition of sand and bitumen in the tar sands, the bitumen may be readily separated from the sand by hot-water separation techniques wherein the bitumen phase is disengaged from the sand phase. U.S. Pat. Nos. 3,556,981; 3,847,789; and 3,893,907 are illustrative of a number of patents describing hot water extraction processes for the separation of bitumen from tar sands.

Bitumen may be separated and recovered from the sand, or solid inorganic components of tar sands by various methods. Commercial hot-water separation processes are described in Kirk-Othmer, Encyclopedia of Chemical Technology, Second Edition, 19, 723–730 (1969) and in E. D. Innes and J. V. D. Fear, "Canada's First Commercial Tar Sand Development," Proceedings of the Seventh World Petroleum Congress, Elsevier Publishing Co., 3, p. 633, (1967) incorporated herein by reference. The hot-water separation processes involve mixing the tar sand with hot water to break up the consolidated mass of sand grains and form a slurry. The slurry thus formed suitably is at a temperature in the range of 100° to 180° F. and has a water content in the range of 15 to 25 percent by weight. Additional water is added to the slurry to increase the water content of the mixture to between about 35 and 55 weight percent and the mixture is introduced into a settling tank containing a body of water preferably maintained at a temperature in the range of about 160° to 180° F. In the settling tank the sand water and bitumen separate from one another by gravity, sand settling to the bottom of the settling tank and the bitumen rising to the surface of the water. The tar or bitumen so recovered consists of a mixture of hydrocarbons and substituted hydrocarbons including organic nitrogen compounds. When separated from the inorganic sand components, and water, the bitumen may be treated as a synthetic crude oil feedstock for the production of fuels and petrochemicals, and for the production of hydrogen or synthesis gas by a partial oxidation process.

The present invention relates to a process wherein tar sands are contacted with hot water in a bitumen extraction step effecting separation of bitumen from sand, the bitumen charged as feedstock to a hydrocracking reaction step wherein it is converted in the presence of hydrogen to lower molecular weight gaseous and liquid products suitable as fuel, and coke or tar, and the coke or tar from the hydrocracking zone charged to a flow-type gasification reaction zone wherein it is subjected to partial oxidation with an oxygen-containing gas. Part of the water from the bitumen separation step is mixed with the coke or tar from the hydrocracking step and charged to the gasification reaction zone while a further part of the water is contacted with hot gases from the coke gasification reaction zone in a water washing zone serving to heat the water which is then returned to the bitumen extraction step as the source of heat required for separation of bitumen from sand by the hot-water process. The gasification process produces hydrogen and carbon monoxide from which hydrogen may be derived for use in the hydrocracking operation. Additionally, hydrogen, synthesis gas, or fuel gas may be exported as a salable product of the process. Carbon or soot contained in the hot gases from the gasification reaction zone is recovered from the gas stream in the water wash zone and is carried by the water to the bitumen recovery step where the carbon is transferred from the water to the bitumen.

The process of this invention provides an improved combination of process steps which interact with one another so that substantially all of the energy required for the hot-water separation step is obtained by partial oxidation of coke or tar produced as a by-product of hydrocracking bitumens derived from the tar sands.

The process of the present invention will be more readily understood from the following detailed description of a preferred embodiment of the process with reference to the accompany FIGURE, which is a schematic flow diagram illustrating a preferred embodiment of the process of this invention.

With reference to the FIGURE, a tar sand, such as an Athabasca Tar Sand, is introduced through line 5 into a hot-water tar sand extraction step 6. The tar sands extraction step may be of conventional design, e.g. the type described in U.S. Pat. No. 3,556,981. Hot water is supplied to the tar sands extraction step through line 7. Sand, from which bitumen has been extracted, is discharged through line 8. The recovered bitumen passes through line 9 to a bitumen processing step 10 which suitably comprises a heavy oil hydrocracking process as disclosed in U.S. Pat. No. 3,891,539, incorporated herein by reference, effecting conversion of bitumen to products of lower molecular weight with the production of residual coke as a byproduct. Hydrogen for the hydrocracking process is supplied through line 11, preferably from a source as described hereinafter. Products of the hydrocracking reaction, including unreacted hydrogen and gaseous hydrocarbons, are discharged through line 12 for the recovery of liquid and gaseous products suitable as fuels or as feedstocks to petrochemical processes.

In one specific embodiment of this invention, coke from the bitumen processing step 10 is withdrawn through line 15 and mixed with water withdrawn from tar sands extraction step 6 through line 16. A slurry of coke in water is made up and passed through line 18 to a partial oxidation type coke gasification process 20. The Texaco gasification process described in U.S. Pat. No. 3,764,547, incorporated herein by reference, is preferred for this purpose. Oxygen, preferably commercially pure oxygen from air, is supplied to the coke gasification process step through line 21. Optionally, tar or heavy liquid residuum from the bitumen processing step 10 may be supplied to the coke gasification process as indicated diagrammatically by dotted line 22.

Hot synthesis gas containing soot in an amount corresponding to from about 0.5 to about 5 weight percent of the carbon in the feedstock is discharged from the gasification reaction zone through line 23 to a water wash step 24. Suitable methods of cooling and water washing the hot gases from the coke gasification process are disclosed in U.S. Pat. No. 4,197,281, incorporated herein by reference. Slag from the coke gasification process is discharged through line 25.

Water is supplied to the water wash step from the tar sand extraction step via lines 16 and 26. In the water wash step 24, hot gas from the coke gasification step is intimately contacted with water cooling the gas stream from the coke gasification reactor, heating the wash water and forming a dispersion of finely divided carbon particles or soot in hot water. The hot wash water from the water wash step 24 containing soot is discharged from the wash step through line 27 and line 7 to tar sands extraction step 6 as the source of hot water for the extraction of bitumen from tar sands. It will be appreciated by one skilled in the art that a relatively large amount of water is retained in the tar sands extraction step and recirculated internally as required to make up the water-tar sands slurry and to disperse the slurry for separation. In the tar sand extraction step, soot contained in the water supplied through line 7 is preferentially wet by the bitumen and transferred from the water phase to the oil or bitumen phase.

Hydrogen for the hydrocracking process may be obtained from the gasification zone. The feed to the gasification reactor preferably comprises commercially pure oxygen (98 mole% $O_2$) at a temperature in the range of 250° to 350° F., hydrocarbon feedstock and steam at a temperature in the range of about 300° to 900° F. The ratio of atoms of oxygen to atoms of carbon in the hydrocarbon feed to the gasification reactor is preferably in the range of about 0.7 to 1.2. The relative proportions of steam and coke or heavy residuum may vary over a wide range, for example, from about 0.2 to about 3 pounds of steam per pound of coke or heavy residuum supplied to the reaction zone. The gasifier may be operated to produce synthesis gas at the pressure desired in the hydrocracking process, e.g. 300 to 1000 psig or higher.

Carbon or soot entrained in the stream of gaseous effluent from the gasifier usually amounts to from about 1 to 3 weight percent of the carbon in the hydrocarbon feed to the gasifier. This soot or particulate carbon is simultaneously removed from the wash water with the bitumen in the hot water extraction step and ultimately recycled to extinction via the hydrocracking step.

Synthesis gas leaving the water wash step comprises carbon monoxide, hydrogen and steam in an amount suitable for conducting the water gas shift reaction to convert carbon monoxide and steam to carbon dioxide and hydrogen by the well known water gas shift reaction. Raw synthesis gas from the water wash step 24 may be passed through lines 30 and 31 to a water gas shift reaction zone comprising a water gas shift reactor and purification means well known in the art whereby substantially pure hydrogen is separated from carbon dioxide, hydrogen sulfide, unconverted carbon monoxide and steam.

Purified hydrogen from the shift conversion reaction step 32 passes through line 11 to hydrocracking reaction step 10 as the source of hydrogen for hydroconversion of the bitumen to products of lower molecular weight. A portion of the raw synthesis gas from water wash step 24 may be passed through lines 30 and 33 to a purification process step 35 for the removal of hydrogen sulfide, carbon dioxide and steam to produce a clean fuel gas or synthesis gas feedstock which is discharged through line 36. Water removed from the raw synthesis gas in either shift conversion reaction system 32 or purification system 35 is returned as condensate through lines 38 and 39, respectively to the water wash step 24.

The following specific example illustrates a preferred embodiment of the process of the present invention as applied to the recovery of a synthetic crude oil from Athabasca Tar Sand.

EXAMPLE

Athabasca Tar Sand in the amount of 5,016,664 pounds per hour at 30 F is fed to a hot-water tar sands extractor together with 396,611 pounds per hour of water at 439 F from the water wash step of the coke gasification unit. Bitumen separated from the tar sand is charged to the hydroprocessing unit at the rate of 702,333 pounds per hour and converted into gaseous and liquid products amounting to 491,633 pounds per hour and producing 210,700 per hour of coke. The coke from the bitumen hydroprocessing unit is slurried in 227,219 pounds per hour of contaminated water from the tar sands extraction unit and charged to the coke gasification unit where it is reacted with commercially pure oxygen containing 98 percent oxygen by volume at 2,340 F. The gasifier produces $263.78 \times 10^6$ standard cubic feet per day of raw synthesis gas at 2340 F and 700 psig containing 141,122 pounds per hour steam, the remainder of the water entering with the slurry having been consumed in the gasifier reactions. Hot gases from the coke gasification reaction step are contacted with water at the rate of 969,819 pounds per hour comprising 169,392 pounds per hour of water from the tar sands extraction step and 800,427 pounds per hour of condensate recycled from the water gas shift reaction and purification steps, together with make-up water from a suitable source. Scrubbed synthesis gas from the water wash step containing 714,330 pounds per hour of steam at 439 F is sent to the water gas reaction step. Hot water containing 16,519 pounds per hour of soot recovered from the raw synthesis gas is discharged from the water wash step at the rate of 396,611 pounds water per hour and returned to the tar sands extraction step at 439 F to supply the heat required for the extraction of bitumen from the tar sands.

The process of the present invention provides a method for the production of liquid and gaseous fuels and various refinery and petrochemical charge stocks from tar sands. The combination of hot-water extraction of tar sands with hydroprocessing to recover an upgraded synthetic crude charge stock and the gasification of coke resulting from hydroprocessing of the bitumen recovered from the tar sands possesses a number of advantages as compared with conventional processing operations. Contaminated water from the tar sands extraction step is employed as slurry medium for the coke from the hydroprocessing step and as scrubbing water for the raw synthesis gas from the gasification reaction step thus eliminating the difficult problems usually associated with cleaning up this badly contaminated water. Mineral components from the water appear in the slag from the coke gasification reactor. The wash water leaving the gasification water wash step contains sufficient heat to satisfy the entire heat requirements of the tar sands extraction step so that no external heat source normally is required for operation of the process.

I claim:

1. A process for the production of liquid and gaseous fuels from tar sands which comprises:

(a) contacting tar sand with hot water containing carbon and mineral contaminants from said tar sand in a tar sands extraction step effecting separation of bitumens and carbon from sand and water containing mineral contaminants from said tar sand;

(b) subjecting said separated bitumen and carbon to hydrocracking with hydrogen under hydrocracking reaction conditions effecting conversion of said bitumen to lower molecular weight hydrocarbons and carbonaceous residue comprising said carbon;

(c) recovering lower molecular weight hydrocarbon products of said hydrocracking reaction;

(d) separating sand from said water containing mineral contaminants;

(e) withdrawing carbonaceous residue comprising said carbon combined with coke or tar from said hydrocracking reaction process and passing said residue together with water containing mineral contaminants from said extraction step to a gasification reaction zone;

(f) reacting said residue and said contaminants with oxygen and steam from said water in said gasification reaction zone at an autogenously maintained temperature in the range of 1800° to 3500° F. with the production of a minor amount of ungasified carbon and slag containing mineral components from said water and producing a hot gas stream comprising carbon monoxide, hydrogen, steam, and entrained carbon;

(g) separating slag from the reaction products of (f);

(h) contacting said hot gas stream from said gasification reaction zone with contaminated water from said extraction step in a water washing zone vaporizing part of the water to steam and effecting removal of carbon from said gas stream and forming a dispersion of carbon in hot contaminated water;

(i) passing said dispersion of carbon and hot contaminated water to said tar sands extraction zone wherein carbon is transferred to said bitumen, and (j) discharging synthesis gas comprising carbon monoxide, hydrogen and steam substantially free from solid carbon particles from said water wash step as a product of the process.

2. A process as defined in claim 1 wherein said extraction step is carried at a temperature within the range of about 150° to 200° F.

3. A process according to claim 1 wherein said gasification is carried out at a temperature in the range of about 2200° to 2500° F.

4. A process according to claim 1 wherein the amount of hot water containing dispersed carbon from said water washing step supplied to said tar sands extraction step is within the range of from about 0.05 to about 1 pound per pound of oil shale treated.

5. A process according to claim 4 wherein said hot water containing dispersed carbon is at a temperature within the range of 400° to 450° F.

6. A process according to claim 1 wherein hydrogen from said synthesis gas is supplied to said hydrocracking step as the source of hydrogen for hydrocracking said bitumens.

7. A process according to claim 1 wherein said water washing step is carried out at a temperature within the range of 400° to 450° F. and a pressure in the range of 250 to 450 psig.

8. A process according to claim 7 wherein a gas stream from said water washing zone comprising carbon monoxide, hydrogen, and steam is passed to a shift conversion reaction zone.

9. A process according to claim 8 wherein hydrogen from said shift conversion reaction zone is supplied to said hydrocracking reaction zone.

10. A process according to claim 1 wherein said coke gasification reaction zone, water washing zone, shift conversion zone, and hydrocracking reaction zone are operated at a pressure within the range of 1000 to 3000 psig.

* * * * *